United States Patent [19]

Imai et al.

[11] Patent Number: 4,522,481

[45] Date of Patent: Jun. 11, 1985

[54] TONER SUPPLY CONTROL METHOD FOR ELECTROPHOTOGRAPHIC COPIER

[75] Inventors: Chikara Imai, Tokyo; Yasushi Koichi, Yamato, both of Japan

[73] Assignee: Ricoh Company, Ltd., Tokyo, Japan

[21] Appl. No.: 548,592

[22] Filed: Nov. 3, 1983

[30] Foreign Application Priority Data

Nov. 9, 1982 [JP] Japan ..... 57-196601

[51] Int. Cl.[3] ..... G03G 15/08

[52] U.S. Cl. ..... 355/3 DD; 355/14 D; 118/689

[58] Field of Search ..... 355/14 D, 3 DD, 3 R, 355/14 R; 118/688, 689, 690, 691

[56] References Cited

U.S. PATENT DOCUMENTS 4,343,548 8/1982 Bares et al. ..... 355/14 D X
4,370,053 1/1983 Hirayama et al. ..... 355/14 D
4,395,112 7/1983 Miyakawa et al. ..... 355/3 DD X
4,436,411 3/1984 Miyoshi et al. ..... 355/14 D
4,462,680 7/1984 Ikeda ..... 355/14 D

*Primary Examiner*—A. C. Prescott
*Attorney, Agent, or Firm*—David G. Alexander

[57] ABSTRACT

Light reflected from a reference pattern having a predetermined reflectivity is focused to a photoconductive element to form a latent image thereon. A degree of deposition of a toner on the latent image is sensed by a sensor and the toner supply to a developing unit is controlled in response to an output of the sensor. A fatigue standard is selected taking into account a fatigue characteristic particular to the photoconductor, so that a bias voltage applied to a developing roller in the developing unit is varied in response to the selected fatigue standard.

10 Claims, 5 Drawing Figures

TONER SUPPLY CONTROL METHOD FOR ELECTROPHOTOGRAPHIC COPIER

BACKGROUND OF THE INVENTION

The present invention relates to a method of controlling the supply of a toner in an electrophotographic copier.

In the art of electrophotographic copiers, there has been proposed a toner supply control method which employs a reference pattern having a predetermined reflectivity. Light image of the reference pattern is focused to the surface of a photoconductive element which is deposited with a uniform electrostatic charge, thereby forming a latent image electrostatically on the photoconductor. The latent image is developed into a toner image by a developing unit. A sensor senses a degree of toner deposition in the toner image and allows the toner supply to the developing unit to be controlled in response to an output thereof.

A problem encountered with such a prior art method is that despite the toner supply control performed as stated above, the toner cannot be adequately supplied to the developing unit when the potential on the surface of the photoconductor is unstable. The toner supply would contaminate the backgrounds of copy sheets if excessive, and allow a carrier to adhere to an image surface if short.

SUMMARY OF THE INVENTION

It is therefore an object of the present invention to provide a toner supply control method for an electrophotographic copier which is capable of eliminating the problem inherent in the prior art method as described above.

It is another object of the present invention to provide a generally improved toner supply control method.

A method of controlling the supply of a toner of the present invention is applicable to an electrophotographic copying machine which includes a photoconductive element and a developing unit which is applied with a bias voltage for development. The toner supply control method comprises the steps of providing a reference pattern having a predetermined reflectivity, forming a latent image associated with the reference pattern electrostatically on a surface of the photoconductive element, setting a fatigue standard which is based on a fatigue characteristic of the photoconductive element, varying the bias voltage applied to the developing unit in response to the set fatigue standard, developing the latent image on the photoconductive element into a toner image, detecting a degree of deposition of the toner on the toner image, and controlling the supply of the toner to the developing unit in response to the detected degree of toner deposition.

In accordance with the present invention, light reflected from a reference pattern having a predetermined reflectivity is focused to a photoconductive element to form a latent image thereon. A degree of deposition of a toner on the latent image is sensed by a sensor and the toner supply to a developing unit is controlled in response to an output of the sensor. A fatigue standard is selected taking into account a fatigue characteristic particular to the photoconductor, so that a bias voltage applied to a developing roller of the developing unit is varied in response to the selected fatigue standard.

The above and other objects, features and advantages of the present invention will become apparent from the following detailed description taken with the accompanying drawings.

DESCRIPTION OF THE PREFERRED EMBODIMENTS

Figure 1:
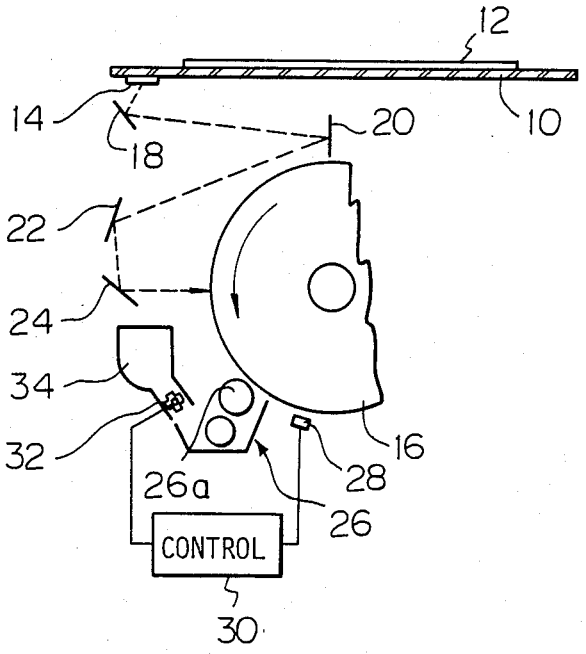
FIG. 1 is a fragmentary schematic diagram of an electrophotographic copier to which the present invention is applicable.

While the toner supply control method for an electrophotographic copier of the present invention is susceptible of numerous physical embodiments, depending upon the environment and requirements of use, substantial numbers of the herein shown and described embodiments have been made, tested and used, and all have performed in an eminently satisfactory manner.

Before entering into detailed discussion of the present invention, a brief reference will be made to a prior art toner supply control method, illustrated in FIG. 1. A copier includes a transparent glass platen 10 on which a desired original document 12 is laid. In a position outside and ahead of a region for loading a document, the glass platen 10 carries on the back thereof a reference pattern 14 having a reflectivity which corresponds to, for example, the halftone of pictures printed on documents. In a copying cycle, a light source (not shown) illuminates the reference pattern 14 on the glass platen 10 and the light reflected therefrom is focused to a photoconductive element 16 by mirrors 18, 20, 22 and 24 and an imaging system (not shown). Formed as a drum as illustrated, the photoconductive element 16 is driven to rotate as indicated by an arrow after being charged uniformly in the dark. Therefore, part of the drum 16 which has been exposed to the light image of the reference pattern 14 is caused to bear an electrostatic latent image of the reference pattern 14 thereon.

The drum 16 moves the latent image therewith to a developing unit 26 as indicated by the arrow in the drawing. While the latent image advances through the developing unit 26, a toner is deposited thereon by a developing roller **26*a* to turn the latent image into a visible toner image. As the drum 16 further rotates, the toner image on the drum 16 moves past a sensor 28 which is positioned adjacent to the drum 16 and downstream of the developing unit 26 with respect to the intended direction of drum rotation. The sensor 28 senses a degree of toner deposition in the toner image and sends out the detected degree to a control unit 30. The control unit 30 functions to control the amount of toner to be fed to the developing unit 26 by controllably driving a toner supply roller 32, which is disposed in a lower portion of a toner hopper 34. The control performed by the control unit 30 may be such that when the amount of toner deposition in the toner image is excessive, the toner supply roller 32 is prevented from rotating and, when it is short, the roller 32** is caused into rotation.

Generally, the surface potential of a photoconductive element becomes quite unstable progressively varying with the operation conditions of the copier. The prior art method described above gives no consideration to the surface potential situation and, therefore, it is not always capable of controlling the toner supply in an adequate and satisfactory manner.

Hereinafter will be described the present invention which is successful to eliminate the drawback states above.

Figure 3:
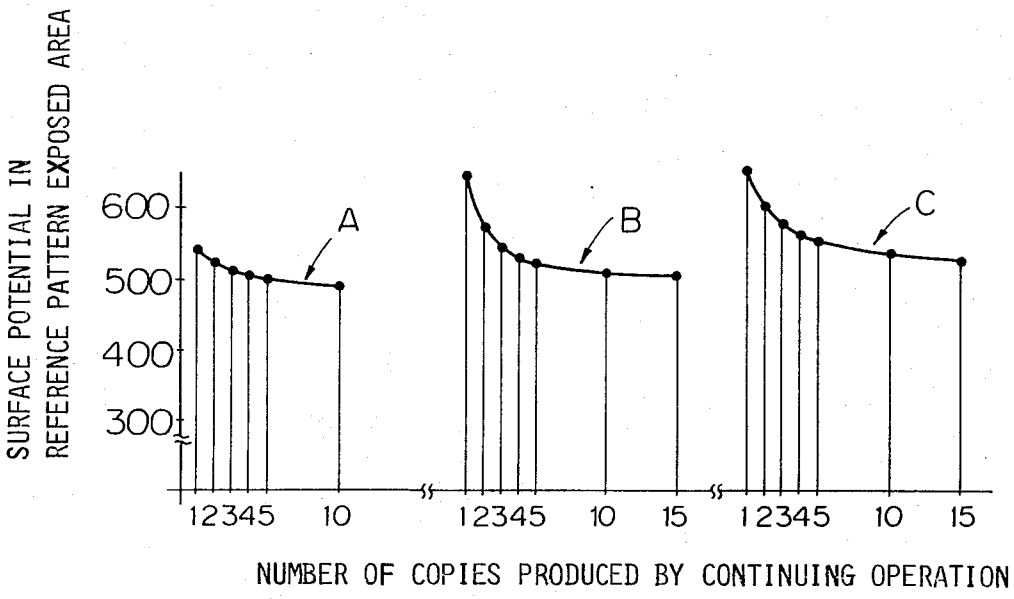
FIG. 3 is a graphic representation of a fatigue characteristic particular to a photoconductive element.

A characteristic feature of a toner supply control method of the present invention consists in varying the bias voltage applied to the developing roller when the latent image of the reference pattern is to be developed, in accordance with a fatigue standard associated with the photoconductive drum. The drawback inherent in the prior art toner supply control as described is due to the fatigue characteristic of the photoconductive element. Concerning a cadmium sulfide (CdS) photoconductor and an arcenic-selenium photoconductor, for example, experiments showed that they undergo fatigue as plotted in FIG. 3. In FIG. 3, each of curves A, B and C, which were attained with an arcenic-selenium photoconductor, indicates a relationship between the surface potential in an area exposed to the reference pattern and a number of copy sheets provided by a continuous repeated operation of the copier, which was resumed respectively after an interval of one minute, that of five minutes, or that of sixty minutes.

It will understood from the curves shown in FIG. 3 that the surface potential in the area exposed to the reference pattern, or reference pattern exposed area as hereinafter called, is higher when the interval is long than when it is short concerning the first copy provided by a continuous copying operation. It follows that, should a single copy be repeatedly produced each after a substantial interval, the toner images would appear relatively high in density due to recovery of the photoconductor from fatigue. In the prior art control method, therefore, the sensor 28 senses the situation wherein the toner density is high, so that the control unit 30 determines toner supply to be sufficient and maintains the toner supply roller 32 inoperative. In practice, however, the surface potential of the photoconductor for producing the first copy is very high as seen from the curve B or C of FIG. 3, consuming the toner by a larger amount than necessary each time. In this manner, the toner supply is suppressed despite the consumption of the toner with the result that the toner concentration in the developing unit 26 is progressively lowered to allow even the carrier associated with the toner to adhere to an image area which is the replica of the document 12.

In a continuous repeated copying operation, on the other hand, the photoconductor has no time to recover from fatigue so that the surface potential in the reference pattern exposed area is lowered to in turn lower the density of the toner image formed therein. Then, in accordance with the prior art control method, the sensor 28 senses the situation wherein the density of the toner image is low and, thereby, causes the control 30 to function with a tendency to rotate the toner supply roller 34 determining that the toner is short. However, due to the surface potential lowered by fatigue as shown in FIG. 3, the image area consumes only a relatively small amount of toner. Despite such small toner consumption, the roller 34 is rotated to supply an excessive amount of toner as stated above, increasing the toner concentration in the developing unit 26 beyond adequate one. This might result in contamination in the backgrounds of copies and/or scattering of the toner into various portions adjacent to the unit 26.

In accordance with the present invention, a unique fatigue standard is set taking into account the fatigue characteristic of a photoconductive element. Based on the fatigue standard, a power source for applying the bias voltage to the developing roller is controlled in such a manner as to compensate a degree of toner deposition on the latent image of the reference pattern, thereby controlling the toner concentration in the developing unit to adequate one.

Figure 2:
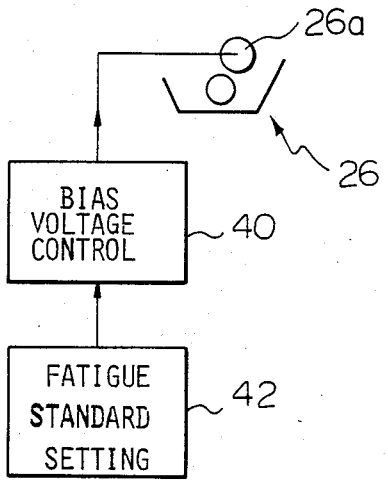
FIG. 2 is a schematic diagram of a developing unit and neighborhood thereof for practicing various examples of a toner supply control method of the present invention.

Referring to FIG. 2, a system for practicing the method of the present invention is shown in a schematic diagram. The system comprises a bias voltage control unit 40 for applying a developing bias to the developing roller **26*a*, and a fatigue standard setting unit 42**.

EXAMPLE 1

In FIG. 2, the fatigue standard setting unit 42 sets a degree of continuous repeated copying operation as a standard. The control is performed such that the bias voltage applied to the developing roller **26*a*** tends to be lowered with the increase in the number of copy sheets produced by a continuous copying operation.

As shown in FIG. 3, the surface potential in the reference pattern exposed area tends to drop with the increase in the number of copies produced by a continuous operation, due to the fatigue characteristic of the photoconductor. In this case, therefore, if the bias voltage is controlled to become lower when the latent image of the reference pattern is to be developed, it becomes easier for the toner to adhere to the latent image of the reference pattern thereby increasing the density in the toner image. Then, the operation of the toner supply roller 34 (see FIG. 1) is interrupted. This eliminates the occurrence that the toner concentration in the developing unit is increased to an unusual level as has been the case with the prior art control method.

Employing the same principle, the bias voltage is controlled to tend to become higher with the decrease in the number of continuously produced copy sheets when the latent image of the reference pattern is to be developed. This prevents the carrier from adhering to the photoconductor due to an unusual decrease in the toner concentration within the developing unit, which has been encountered with the prior art control method.

EXAMPLE 2

In FIG. 2, the fatigue standard setting unit 42 sets a degree of suspension of copying operation, or interval, as a standard. The control occurs with such a tendency that the bias voltage concerned becomes higher with the increase in the interval when the latent image of the reference pattern is to be developed.

As shown in FIG. 3, the surface potential in the reference pattern exposed area shows a tendency to rise with the increase in the interval due to the fatigue characteristic of the photoconductor. Therefore, if the control is performed in such a manner as to provide the bias voltage with a tendency to rise when the latent image of the reference pattern is to be developed, deposition of the toner on the latent image of the reference pattern is suppressed resulting in a decrease in the density of the toner image. At this instant, the toner supply roller 34 (see FIG. 1) is caused into rotation. The toner concentration, therefore, is prevented from increasing to an unusual level within the developing unit, which level has been unavoidable in the prior art control method.

With the same principle, the bias voltage is controlled with a tendency to become lower with the decrease in the interval when the latent image of the reference pattern is to be developed. As a result, there is precluded the occurrence particular to the prior art method that the toner concentration in the developing unit rises to an unusual level to contaminate the background area and/or to scatter in all directions in the neighborhood of the developing unit.

EXAMPLE 3

The standard set by the setting unit 42 this time is concerned with whether a copy to be produced is the first copy or not after a predetermined suspension period or interval. If the copy is the first copy after such an interval, the control occurs such that the developing bias tends to be lowered; if otherwise, such that the developing bias tends to be raised.

Figure 5:
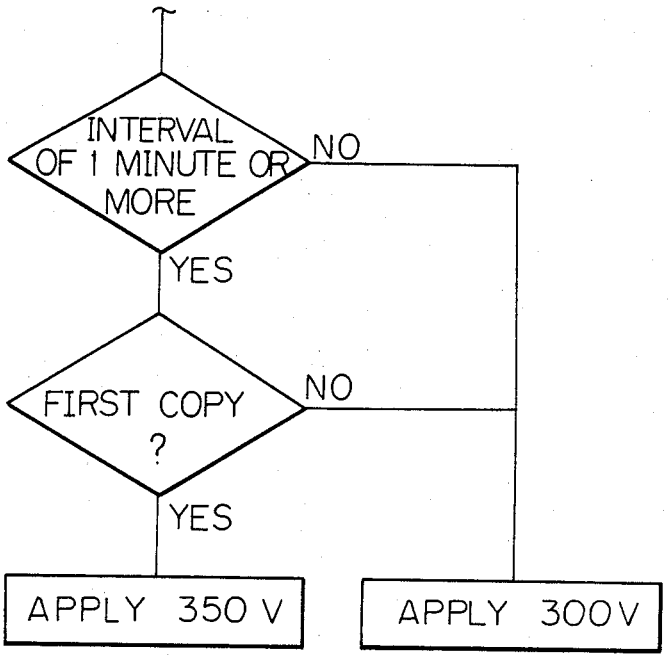
FIG. 5 is a flowchart representing one example of the present invention.

As indicated by the curve A of FIG. 3, the surface potential in the reference pattern exposed area is collectively low after a one minute interval while, as indicated by the curves B and C, it is higher for the second copy and onward than for the first copy after a five minute interval and a sixty minute interval. Therefore, the bias voltage for the development of the latent image of the reference pattern is limited to 300 V as shown in FIG. 5 when a copy sheet is to be produced before a one minute or longer interval expires after the immediately preceding copy sheet or, if such an interval has expired, when the copy sheet is not the first one in a continuous copying operation. This allows the toner to be readily deposited on the latent image of the reference pattern, thereby increasing the density in the toner image. Then, the toner supply roller 34 (see FIG. 1) is controlled with a tendency to restrict the toner supply. As a result, the toner concentration in the developing unit is prevented from increasing to an unusual level, in contrast to the prior art control method.

Further, where the one minute or longer interval has expired and a copy to be produced is the first one, the surface potential in the reference pattern exposed area tends to remain high. Hence, the developing bias voltage is increased to 350 V. This makes it difficult for the toner to adhere to the latent image of the reference pattern, thereby lowering the density of the toner image. The roller 34 is then controlled with a tendency to increase the toner supply, so that the toner concentration in the developing apparatus is prevented from becoming unusually low as has been encountered with the prior art control method.

The operation represented by the flowchart of FIG. 5 may be executed as follows. The electrophotographic copier is provided with a timer. When one minute or longer time has expired before the next copy mode is set up after the production of a copy, a high level control signal is delivered to the bias voltage control 40. Only when a copy counter has counted the first copy after an interval, a high level control signal is sent out to the bias voltage control 40. The two different control signals are fed to a simple AND gate having two input terminals so that the AND gate delivers a high level control signal only after the lapse of one minute or longer time and if a copy to be produced is the first one. This high level control signal is detected to raise the developing bias voltage assigned to a low level by 50 V. As a result, a voltage of 350 V is applied to the developing roller. When the bias voltage was controlled to 350 V for the first copy and to 300 V for the second copy and onward each after the lapse of one minute or more, the fluctuation of the toner concentration in the developing unit was confined to a range of 2.5–4 Wt %. In this connection, when the bias voltage was fixed to uncontrolled 300 V without employing the principle of the present invention, the toner concentration was reduced even to 2 Wt % or lower which means a decrease in allowance concerning deposition of the carrier particles. Conversely, when the voltage was fixed to uncontrolled 350 V, the toner concentration was increased even to 5 Wt % tending to result in smearing in the background area, scattering of the toner, etc.

Figure 4:
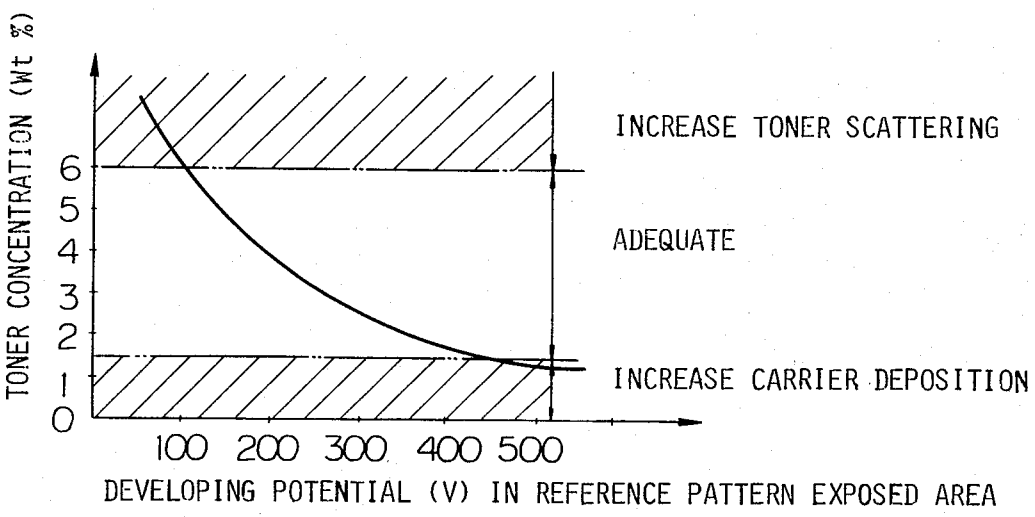
FIG. 4 is a graph showing an exemplary range of adequate toner concentration in a developing unit.

It is generally accepted that an adequate range of toner concentration in a developing unit is on the order of 1.6–6.0 Wt %, as shown in FIG. 4. The curve shown in FIG. 4 may give an acceptable standard for a developing potential of the reference pattern exposed area which attains such adequate concentration range, i.e. a difference in potential between the latent image of the reference pattern and the bias voltage.

The data shown in FIG. 4 may be relied on as a reference in presetting developing bias voltages in accordance with the present invention.

As described above, the bias voltage for developing a latent image of a reference pattern is varied in response to a fatigue standard associated with a photoconductor. However, another standard such as one manually provided by operator's decision is employed for a bias voltage for developing a latent image of an original document because it directly effects the quality of copies and has to be set up with various conditions taken into account.

While the reference pattern is located at the leading end or trailing end of a glass platen as shown in FIG. 1, the control in accordance with the present invention does not have to be performed for every copying cycle and, instead, may be performed once for ten consecutive copying cycles, for example.

Various modifications will become possible for those skilled in the art after receiving the teachings of the present disclosure without departing from the scope thereof.

What is claimed is:

1. A method of controlling supply of a toner in an electrophotographic copying machine including a photoconductive element and a developing unit which is applied with a bias voltage for development, said method comprising the steps of:

(a) providing a reference pattern having a predetermined reflectively;

(b) forming a latent image associated with said reference pattern electrostatically on a surface of the photoconductive element;

(c) setting a fatigue standard which is based on a fatigue characteristic of the photoconductive element;

(d) varying the bias voltage applied to the developing unit in response to the fatigue standard;

(e) developing the latent image on the photoconductive element into a toner image;

(f) detecting a degree of deposition of the toner on the toner image; and (g) controlling the supply of the toner to the developing unit in response to the detected degree of toner deposition.

2. A method as claimed in claim 1, in which the fatigue standard set in step (c) is a degree of continuous repeated copying operation, step (d) comprising a step of (h) lowering the bias voltage as a number of copies provided by a continuous repeated copying operation increases.

3. A method as claimed in claim 1, in which the fatigue standard set in step (c) is a degree of suspension of operation of the photoconductive element, step (d) comprising a step of (h) raising the bias voltage as an operation suspension time of the photoconductive element increases.

4. A method as claimed in claim 1, in which the fatigue standard set in step (c) is whether a copy to be produced is the first copy or not after the lapse of a predetermined operation suspension time of the photoconductive element.

5. A method as claimed in claim 4, in which step (h) comprises a step of (i) raising the bias voltage to 350 V when the copy to be produced is the first copy and lowering the bias voltage when the copy to be produced is not the first copy.

6. A method as claimed in claim 1, in which the photoconductive element is made of an arcenic-selenium composition.

7. A method as claimed in claim 1, in which the photoconductive element is made of cadmium sulfide.

8. A method as claimed in claim 1, in which step (a) comprises a step of (h) locating the reference pattern in a position on a glass platen which is outside a document loading area.

9. A method as claimed in claim 8, in which step (h) comprises a step of (i) locating the reference pattern in at least one of leading and trailing end portions of the glass platen outside the document loading region.

10. A method as claimed in claim 1, further comprising a step of (h) providing a second standard for varying the bias voltage when an electrostatic latent image associated with an image carried on a document is to be developed.

* * * * *